United States Patent [19]

Lehmann

[11] Patent Number: 4,743,469

[45] Date of Patent: May 10, 1988

[54] METHOD OF APPLYING ADHESIVE TO CONTAINERS IN LABELING MACHINES

[75] Inventor: Reiner Lehmann, Nottuln, Fed. Rep. of Germany

[73] Assignee: Langguth GmbH & Co., Münster, Fed. Rep. of Germany

[21] Appl. No.: 41,103

[22] PCT Filed: Jun. 28, 1986

[86] PCT No.: PCT/DE86/00272

§ 371 Date: Mar. 19, 1987

§ 102(e) Date: Mar. 19, 1987

[87] PCT Pub. No.: WO87/00507

PCT Pub. Date: Jan. 29, 1987

[30] Foreign Application Priority Data

Jul. 23, 1985 [DE] Fed. Rep. of Germany ..... 3526178

[51] Int. Cl.[4] ..... B05D 5/10

[52] U.S. Cl. ..... 427/208.2; 427/348

[58] Field of Search ..... 427/348, 208.2

[56] References Cited

U.S. PATENT DOCUMENTS

| | | | |
|---|---|---|---|
| 2,396,946 | 3/1946 | Grupe | 427/348 X |
| 3,953,626 | 4/1976 | Suzuki et al. | 427/348 X |
| 4,460,631 | 7/1984 | Stegmeier et al. | 427/348 X |

*Primary Examiner*—Bernard D. Pianalto

*Attorney, Agent, or Firm*—Peter K. Kontler

[57] ABSTRACT

The invention relates to a method of applying an adhesive, e.g., hotmelt, to containers in labeling machines. The hotmelt is contactlessly applied to the containers to be labeled by means of a nozzle applicator. After application of the adhesive to the object to be labeled, the adhesive spot or adhesive bead produced in this manner is distributed over a wide area by means of a stream of pressurized gas, e.g., pressurized air.

3 Claims, No Drawings

METHOD OF APPLYING ADHESIVE TO CONTAINERS IN LABELING MACHINES

The invention relates to a method of applying adhesive to containers in labeling machines.

A method of this type is shown, for example, in FIG. 12*a*, page 20 of the September 1975 edition of "Handbuch der Etikettiertechnik" published by Hermann Kronseder, Neutraubling, German Federal Republic. In this method, a bead of hotmelt is "contactlessly" applied to a container which is to be labeled and is transported by a nozzle for hotmelt. The container is subsequently advanced from this adhesive applying station to a magazine for labels. Along such path, the container is additionally caused to rotate about its axis.

At the high speeds of advance normally employed in labeling machines today, this known method has the result that the hotmelt applied to the container is flung from the outer surface of the container due to the rotational speed of the container. In modern machines, the containers rotate at a tangential velocity of 150 to 250 meters per minute. The hotmelt, which is still in a flowable state, enters the labeling machine and causes the machine to become unusable within a very short period of time.

The speed of advance of the container must be high to insure that the heated hotmelt, which is sticky only in this condition, is capable of removing a label from the label magazine. The label is then rolled around the container due to the rotation of the container. Since it is unavoidable that the applied spot or bead of hotmelt is raised, the label is observed to have small projections in this area. These are regarded as unsightly by consumers.

The "contactless" application of the hotmelt overcomes the drawbacks which arise in those methods where the glue or hotmelt is applied to the exterior of the container via gluing rollers. The latter mode of application brings with it the danger of soiling due to contaminants on the outside of the container.

Thus, although the "contactless" glue application method has substantial advantages, it has not been possible to employ such method in practice to the satisfaction of the manufacturer of the labeling machines and of the consumer.

It is an object of the invention to further develop a method of the character described such that the "contactlessly" applied adhesive bead, or the "contactlessly" applied adhesive spot, is distributed over as large an area as possible without the fear of adhesive particles being carried into the surrounding machine components.

Spray pistols which may be used for the application of hotmelt and are capable of covering large areas with glue are known. Here, similarly to spray pistols for lacquer, the hotmelt discharged from the nozzle is atomized and brought onto the object support by a unidirectional stream of pressurized air. With this known method, particles of hotmelt cannot be prevented from entering the atmosphere and being introduced into the surrounding machine components, e.g., of labeling machines, thereby causing the machine to become unusable.

In the method of the invention, this drawback of the known method employing spray pistols is avoided by applying the pressurized air to the adhesive only after it has been deposited on the object support.

The West German Offenlegungsschrift No. 34 38 041 discloses a method which operates with a pneumatic doctor and in which flowable coating masses applied to bands of material are subjected to an aftertreatment. During normal operation, the applicator deposits an excess of the coating mass on the band and this excess is removed by the pneumatic doctor. However, even when the supply of the coating mass is adjusted in such a manner that no substantial excess of coating mass exists, the pneumatic doctor still has a favorable effect on the quality of the coating.

Advantageous embodiments of the invention are set forth in the dependent claims.

In addition to the advantages outlined previously, the method of the invention makes it possible to cool or heat hotmelt by means of the air stream so that the setting characteristics of the hotmelt can be controlled in dependence upon its chemical composition and the nature of the object support.

By increasing the area of the adhesive on the object support, a larger adhesive surface is created so that improved withdrawal of the labels from the label magazine is achieved. At the same time, the thickness of the adhesive on the object support is smaller so that the adhesive area is subsequently no longer observable at the upper surface of the label. The hotmelt accordingly does not affect the label.

I claim:

1. A method of applying an adhesive, such as hotmelt, to discrete containers which are in labeling machines and are to be labeled, comprising the steps of contactlessly applying to containers beads of adhesive by means of a nozzle applicator, and distributing each adhesive bead over a wide area of the respective container by means of a pressurized gas stream after application of the adhesive to the container, said distributing step including directing each pressurized gas stream at least substantially concentrically to the respective bead.

2. A method according to claim 1, further comprising the step of heating the gas of the pressurized gas stream.

3. A method according to claim 1, further comprising the step of cooling the gas of the pressurized gas stream.

* * * * *